United States Patent [19]

Meyer et al.

[11] Patent Number: 4,607,563

[45] Date of Patent: Aug. 26, 1986

[54] FIRING MECHANISM FOR AN AUTOMATIC FIRING WEAPON

[75] Inventors: Albert Meyer, Widen; Hans Hofmann, Zürich; Hans Häferli, Endingen, all of Switzerland

[73] Assignee: Werkzeugmaschinenfabrik Oerlikon-Bührle AG, Zürich, Switzerland

[21] Appl. No.: 603,184

[22] Filed: Apr. 23, 1984

[30] Foreign Application Priority Data

Apr. 29, 1983 [CH] Switzerland ..... 2306/83

[51] Int. Cl.[4] ..... F41D 11/02

[52] U.S. Cl. ..... 89/132

[58] Field of Search ..... 89/132

[56] References Cited

U.S. PATENT DOCUMENTS

| | | | |
|---|---|---|---|
| 3,051,056 | 8/1962 | Kuyvenhoven et al. | 89/132 |
| 3,174,399 | 3/1965 | Brieger | 89/132 |
| 4,458,578 | 7/1984 | Gerndt et al. | 89/132 |

FOREIGN PATENT DOCUMENTS

| | | |
|---|---|---|
| 2323352 | 11/1974 | Fed. Rep. of Germany . |
| 2511765 | 12/1976 | Fed. Rep. of Germany . |
| 3103964 | 9/1982 | Fed. Rep. of Germany . |
| 2204789 | 5/1974 | France . |

*Primary Examiner*—Stephen C. Bentley

*Attorney, Agent, or Firm*—Werner W. Kleeman

[57] ABSTRACT

The firing mechanism for an automatic firing weapon comprises a catch pawl or detent by means of which a to-and-fro moving weapon breechblock can be retained in its rear or rearmost position. To prevent damage to the breechblock or the catch pawl it is necessary, upon impact of the breechblock against the catch pawl, for such catch pawl to have been completely pivoted into the path of travel of the breechblock. The release of the catch pawl, which can be pivoted by the action of a spring into the path of travel of the breechblock, is accomplished by a feeler lever. This feeler lever fixedly retains the catch pawl in its breechblock release position by means of a firing or trigger lever. The feeler lever is retained, on the one hand, by a control or cam surface of the breechblock and, on the other hand, by a stop lever in its locking position in which it holds the firing lever in a position preventing the catch pawl from engaging with the breechblock. The stop lever can be pivoted out of its locking position for the feeler lever by a release lever which can be actuated in conjunction with the firing lever.

7 Claims, 4 Drawing Figures

FIRING MECHANISM FOR AN AUTOMATIC FIRING WEAPON

BACKGROUND OF THE INVENTION

The present invention broadly relates to firing mechanisms, and, in particular, concerns a new and improved construction of a firing mechanism for an automatic firing weapon.

Generally speaking, the firing mechanism for an automatic firing weapon of the present development is of the type comprising a breechblock provided with a catch surface and the underside of which breechblock serves as a control or camming surface for controlling the firing mechanism. There is also provided a spring-loaded catch pawl or detent which is pivotably mounted in a firing mechanism housing. The catch pawl or detent, when in its breechblock catch position, protrudes into the path of travel of the breechblock. There is also provided a firing or trigger lever which can be actuated by a firing or trigger table or equivalent structure. This firing or trigger lever serves for pivoting the catch pawl out of its breechblock catch position into a breechblock release position. A feeler or sensor lever is provided, which is pivotable by the action of the underside of the breechblock out of a locking position for the firing lever into a release position for such firing lever.

According to a state-of-the-art firing mechanism of the aforementioned type, as disclosed in German Pat. No. 3,103,864, published Sept. 2, 1982, the breechblock of the firing weapon is equipped with a catch shoulder and a control surface coacting with this firing mechanism. Such firing mechanism is arranged within a housing and possesses a first control lever with can be actuated by a firing table. There is also provided a second control lever which can be actuated by the control surface of the breechblock body. Additionally, there is provided a catch pawl which can be pivoted or rocked into the path of movement of the catch shoulder. This catch pawl can be actuated by both of the aforementioned control levers. The second control lever, constituting a release lever, is pivotably arranged at a holder lever. This holder lever is mounted to be pivotable, against the force of a holding or retaining spring, about a pivot shaft which is fixed in the housing. A nose member of the holder lever retains the catch pawl in a first clearly defined intermediate position which only can be released by the action of the body of the breechblock. The first control lever is pivotably mounted as a firing lever in the housing and a stop lever for the catch pawl is displaceably arranged at such firing lever. The catch pawl possesses at its rear end, above a stop surface which coacts with the stop lever, a concave surface for the deflective contact with the stop lever in a second intermediate position. The holder lever can be deflected or moved in counterclockwise direction by the body of the breechblock through the action of the release lever, in order to release the catch pawl from the first intermediate position.

This heretofore known firing mechanism essentially solves the same objectives as the present invention, namely prevents damage of the catch surface at the breechblock and the impact or stop surface at the catch pawl. Such damage can arise when there occurs impact of the breechblock against the catch pawl before the catch pawl has completely reached its breechblock catch position. The breechblock only should be caught during such time as there is present a full area or surface impact of its catch surface against the impact or stop surface of the catch pawl.

It is to be appreciated, however, that the aforementioned prior art firing mechanism fulfills such object in a completely different manner.

1. The mode of operation of the known firing mechanism is exactly the converse of that of the present invention. With the control surface of the breechblock there is brought about a release of the catch pawl for enabling its pivoting into the breechblock catch position. In contrast thereto, the invention contemplates that with the control surface of the breechblock there is prevented release of the catch pawl for pivoting into the breechblock catch position.

2. The control lever of the prior art firing mechanism is pivotably arranged at a holder lever and the stop lever of the known firing mechanism is pivotably arranged upon the firing lever. In contrast thereto, the invention contemplates that all levers or lever members are pivotably mounted about housing-fixed shafts, or, stated in a different manner, all of the pivot shafts are secured in the housing of the firing mechanism.

3. The release lever of the prior art firing mechanism impacts by means of a relatively pronounced rounded nose member or nose against the control surface of the breechblock. In contrast thereto, the feeler or sensing lever of the inventive firing mechanism impacts by means of a feeler surface which is inclined with respect to the path of movement of the breechblock against the control or camming surface of the breechblock.

Moreover, the aforementioned state-of-the-art firing mechanism has the following drawbacks:

1. The elements which are pivotably mounted upon pivotable levers constitute a disturbance-prone construction of the firing mechanism, particularly when confronted with the pronounced vibrations of the firing weapon, typically a cannon.

2. The impact of the breechblock against the markedly or pronouncedly rounded nose or nose member of the release lever results in considerable wear.

SUMMARY OF THE INVENTION

Therefore, with the foregoing in mind it is a primary object of the present invention to provide a new and improved construction of a firing mechanism for an automatic firing weapon, which is not afflicted with the aforementioned drawbacks and limitations of the prior art heretofore discussed.

Another and more specific object of the present invention aims at providing a new and improved construction of a firing mechanism of the character described which does not possess the aforementioned drawbacks and shortcomings and which is appreciably simpler in its construction.

Still a further significant object of the present invention is to provide a new and improved construction of a firing mechanism for an automatic weapon, which firing mechanism is relatively simple in construction and design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the firing mechanism of the present development is manifested by the features that there is provided a stop lever which is pivotably mounted in the firing mechanism housing from a release position into a locking or blocking position, in order to retain the feeler lever in its locking position into which it is pivotable by the control surface of the breechblock and in which the feeler lever fixedly retains the catch pawl in its breechblock release position by means of the firing lever. There is also provided a release lever which is pivotably mounted in the firing mechanism housing. This release lever bears together with the firing lever upon the firing table and is intended for releasing or delatching the stop lever.

The firing mechanism is not dependent upon the weapon operator during the release of the catch pawl or detent, i.e., the firing mechanism can not be released at an unfavorable moment or period of time. Equally, there is not possible any slow release of the catch pawl, since the release action is controlled by the breechblock.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
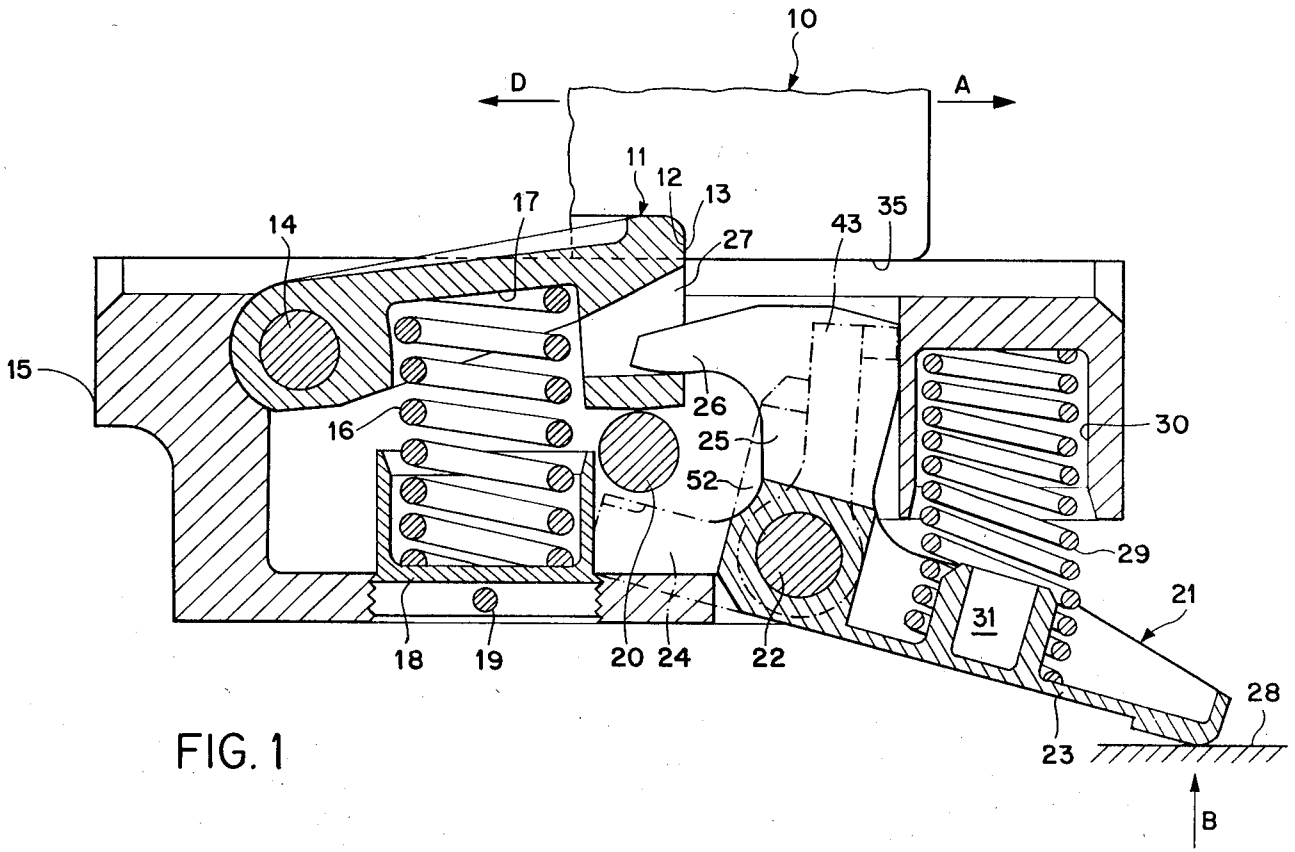
FIG. 1 is a schematic longitudinal section through a firing mechanism or apparatus constructed according to the present invention and taken substantially along the line I—I of FIG. 3.

Describing now the drawings, it is to be understood that only enough of the construction of the firing mechanism and its related automatic firing weapon have been shown in the drawings to enable those skilled in the art to readily understand the underlying principles and concepts of the present development, while simplifying the illustration of the drawings. Turning attention now to such drawings, it is to be understood that the exemplary embodiment of inventive firing mechanism or apparatus is intended for use with an automatic firing weapon, wherein in FIGS. 1 and 2 only a part of a to-and-fro or reciprocating breechblock 10 is shown. In the illustration of FIG. 1 this breechblock 10 is depicted in its rearmost or rear position and is retained in such position by a catch pawl or detent 11 or equivalent sear structure. For this purpose the breechblock 10 possesses an impact or abutment surface 12 which bears against a catch or stop surface 13 of the catch pawl 11. Since during catching of the breechblock 10 by the catch pawl 11 there arise extremely great forces, amounting to as much as six tons, it is important that upon impact of the impact surface or abutment 12 of the breechblock 10 against the catch or stop surface 13 of the catch pawl 11, that such catch pawl 11 be located completely in the position depicted in FIG. 1, in order to prevent damage to the breechblock 10 or the catch pawl 11, or both. During return movement of the breechblock 10 in the direction of the arrow A the catch pawl 11 is pivoted or rocked out of the path of travel of the breechblock 10 and then must again be properly pivoted back into the breechblock catch position depicted in FIG. 1 at the proper point in time, in order to ensure that the entire area of the breechblock impact surface 12 impinges against the entire catch surface 13 of the catch pawl 11.

It is a primary object of the present invention to ensure positive and reliable fulfillment of such function.

Continuing, and again reverting to FIG. 1, it will be observed that the catch pawl 11 is pivotally mounted about a pivot shaft 14 which extends transversely with respect to the direction or path of movement of the breechblock 10, generally indicated by the arrows A and D. This transversely extending pivot shaft 14 is secured in a housing 15 of the firing mechanism. This housing 15 is sometimes conveniently referred to herein as the firing mechanism housing or also briefly simply as the firing housing. Such housing 15 is resiliently mounted in the weapons system in any suitable matter, in order to resiliently take-up the aforementioned impact of the breechblock 10 against the catch pawl or detent 11. In order to be able to retain the catch pawl 11 in the breechblock catch position depicted in FIG. 1, there is provided a strong compressing or helical spring 16 or equivalent structure. This compression or helical spring 16 is supported at one end in a recess 17 of the catch pawl 11 and, at its opposite end, is supported upon a substantially pot-shaped spring bearing or support 18. This spring bearing or support 18 possesses a not particularly referenced threaded portion and is threaded into an opening of the firing mechanism housing 15. In order to conveniently alter the pre-bias or loading of the spring 16, the spring bearing or support 18 can be optionally threaded to a greater or lesser extent into the firing mechanism housing 15. A pin 19 or the like secures the spring bearing 18 against any unintentional rotation. By means of a laterally displaceable bolt member 20 it is possible to secure the catch pawl 11, in its breechblock catch position depicted in FIG. 1, against any unintentional pivoting or rocking motion. To release a shot this bolt member 20 first must be appropriately displaced, for instance shifted, in the direction of its lengthwise axis and if necessary possibly turned through about 180°, so that a substantially semi-circular portion **20*a* thereof assumes a position as shown in FIG. 2 which enables pivotable movement of the catch pawl 11**.

Figure 4:
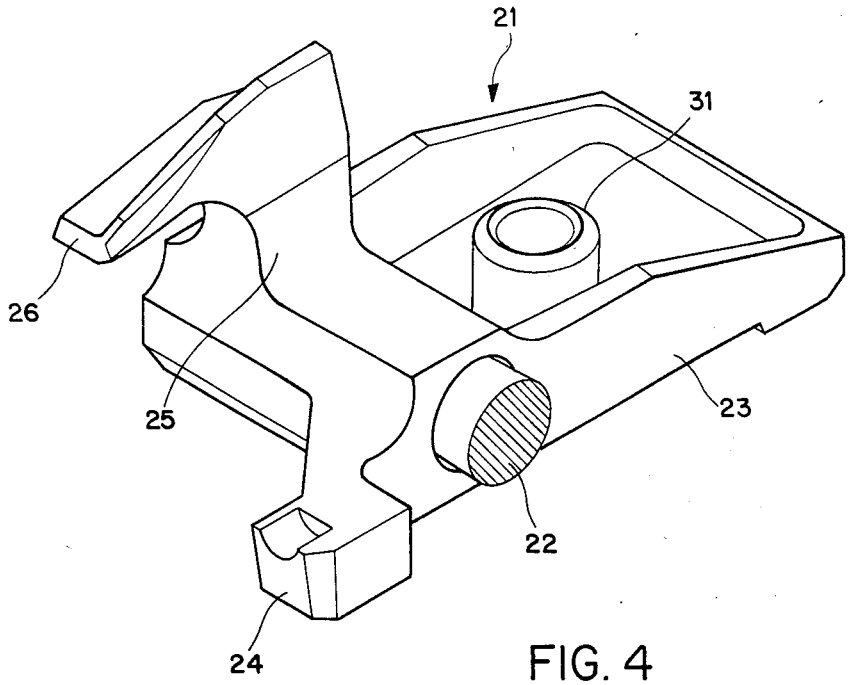
FIG. 4 is a perspective view showing details of the firing trigger lever used in the arrangement of FIGS. 1–3.

Now in order to actuate the catch pawl or detent 11 there is advantageously provided a firing or trigger lever. This firing or trigger lever 21 is pivotably mounted about a pivot shaft 22 which likewise is attached so as to extend transversely with respect to the direction of movement A–D of the breechblock 10 within the housing 15 of the firing mechanism. This firing or trigger lever 21 possesses three arms or arm members 23, 24 and 25, as best seen by referring to FIG. 4. According to the showing of FIG. 4, the arm or arm member 25 is disposed substantially perpendicular to both of the essentially horizontally directed arms or arm members 23 and 24. The vertically directed arm member 25 engages by means of a nose or nose member 26 into a recess or opening 27 of the catch pawl 11 and serves to actuate such catch pawl 11. The arm member 23 which is directed towards the right-hand side of the illustration of FIGS. 1 and 4, bears upon a firing or trigger table 28 or equivalent structure which, in known manner, can be elevationally upwardly displaced or raised for the purpose of releasing a shot. A pressure or compression spring 29, which bears at its one end in a blindhole bore 30 of the firing mechanism housing 15 and at its other end bears against the arm member 23 of the firing lever 21, strives to pivot the firing lever 21 into the position depicted in FIG. 1 where the breechblock 10 is caught by the catch pawl or detent 11. A plug or boss 31 secured to the arm member 23 serves to guide the compression or pressure spring 29 and, in conjunction with the blindhole bore 30, prevents any undesired kinking or bowing out of the compression or pressure spring 29. The third arm member 24 serves for locking the firing or trigger lever 21 in its release position depicted in FIG. 2 and cooperates with a locking bolt or bolt member 36 which will be described more fully hereinafter.

Figure 2:
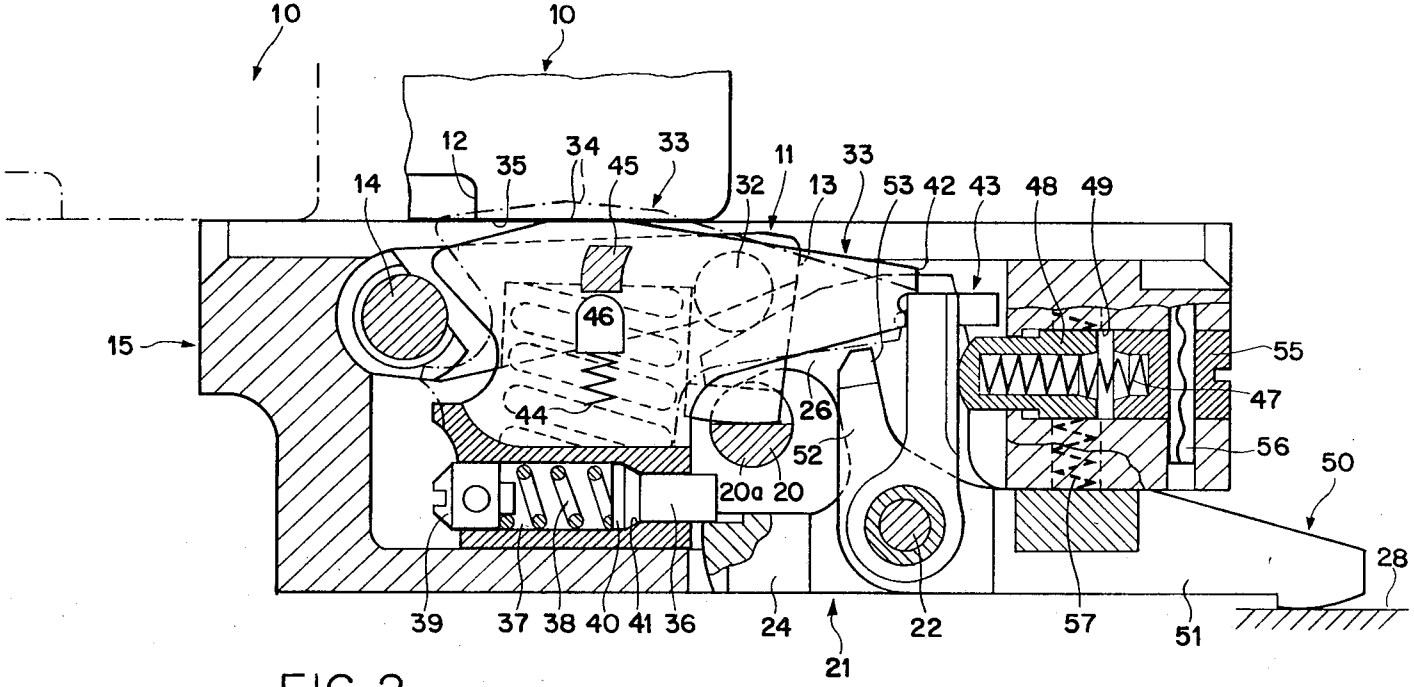
FIG. 2 illustrates a longitudinal section, neighboring the longitudinal section shown in FIG. 1, through the same firing mechanism or apparatus and taken substantially along the line of II—II FIG. 3.

According to the showing of FIG. 2, a breechblock feeler or sensing lever 33 is pivotably mounted about a pivot shaft 32. Just as was the case for the pivot shafts 14 and 20 this pivot shaft 32 is likewise secured in the firing mechanism housing 15 so as to extend transversely with respect to the direction of movement A–D of the breechblock 10. This feeler lever or lever member 33 possesses a feeler or sensing surface 34 which coacts with the underside 35 of the breechblock 10. This underside 35 of the breechblock 10 is constructed as a control or camming surface. Furthermore, there is displaceably mounted into a bore 37 of the feeler lever 33 the aforementioned locking or blocking bolt or bolt member 36. A spring 38 bears at its one end at the locking bolt 36 and at its other end against a pin or plug 39 inserted into the bore 37 and strives to press the locking bolt 36 into its locking or blocking position depicted in FIG. 2.

This locking bolt or bolt member 36 possesses a head portion or head 40 which is pressed by the action of the spring 38 against a shoulder or seat 41 provided in the bore 37. As also will be observed by inspecting FIG. 2, the arm member 24 of the firing or trigger lever 21, in the depicted position, bears against the locking bolt 36. The breechblock feeler lever 33 additionally possesses a nose member 42 which coacts with a stop lever 43 which, as here shown, can engage the feeler or sensing lever 33 from below. In the position depicted in FIG. 2, the stop lever or 1ever member 43 prevents pivoting of the breechblock feeler lever 33 in the clockwise direction. A spring 44 strives to pivot the feeler lever 33 in such clockwise direction, and thus, to press the nose or nose member 42 of the feeler lever 33 against the stop lever 43. Regarding this spring or spring member 44 there has only been conveniently depicted in FIG. 2 the upper end or end region thereof which bears by means of a bolt member 46 or the like against an impact or abutment 45 of the feeler or sensing lever 33.

The stop lever 43 is pivotably mounted about the aforementioned pivot shaft 22. The not particularly depicted end of the spring 44 is supported in a suitable blindhole bore of the firing mechanism housing 15. A spring 47, located in a bore 49 of the firing mechanism housing 15, bears by means of its one end via a sleeve member 48 at the stop lever 43 and strives to rock this stop lever 43 in the counterclockwise direction, and thus to press such stop lever 43 against the nose member 42 of the feeler lever 33. In order to actuate the stop lever 43 there is provided a release lever or lever member 50 which bears by means of one arm 51 thereof upon the firing table 28, just as does the aforementioned firing or trigger lever 21. The other arm or arm member 52 of the release lever 50 possesses an abutment or impact member 53 which coacts with the stop lever 43. This impact member 53 can strike or bear against the stop lever 43 and rock such stop lever 43 in the clockwise direction against the force of the spring 47.

Figure 3:
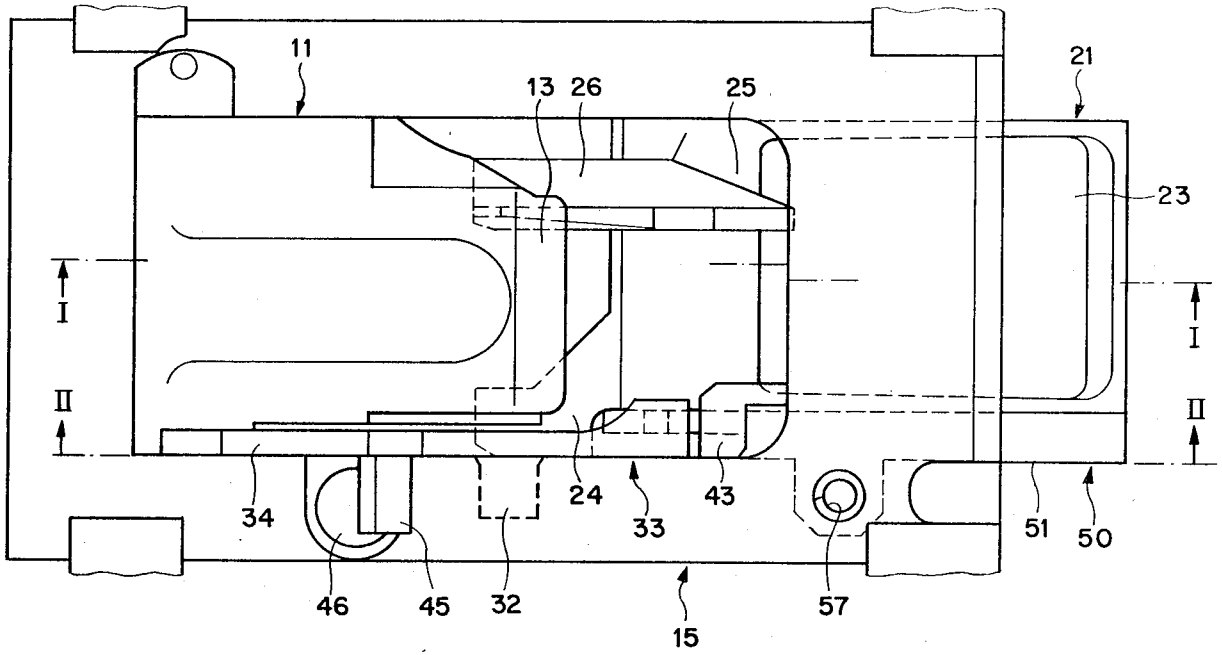
FIG. 3 is a top plan view of the firing mechanism or apparatus of the invention.

As will be recognized by inspecting FIGS. 2 and 3, a spring member 57, which bears at its one end at the firing mechanism housing 15 and at its other end at the arm member 51 of the release lever 50, strives to rock the release lever 50 in the clockwise direction, and thus, to pivot the stop lever 43 out of its position depicted in FIG. 2 into the position depicted in FIG. 1. As a result the feeler or sensing lever 33 is released. A centering bushing 55 or equivalent structure which is inserted into the firing mechanism housing 15 serves for adjusting the pre-bias of the spring 47. The release lever 50 is conjointly pivotably mounted along with the stop lever 43 and the firing or trigger lever 21 upon the aforementioned pivot shaft 22. The centering bushing 55 is appropriately secured in place by a pin member or dowel 56 or the like.

Having thus had the benefit of the foregoing detailed description of the exemplary embodiment of firing mechanism or apparatus for an automatic firing weapon, there will be now described its mode of operation which is as follows:

To release a shot the firing table 28 or equivalent structure is raised in known manner in the direction of the arrow B of FIG. 1. As a result, both the firing lever 21 and also the release lever 50 are pivoted in counterclockwise direction about the pivot shaft 22 and are moved out of the position depicted in FIG. 1 into the position depicted in FIG. 2. The nose member or nose 26 of the firing lever 21 thus impacts against the catch pawl 11 and pivots such in the clockwise direction to such an extent that the breechblock 10 is released and can trigger the first shot under the force of an not particularly illustrated but conventional advance spring, with the result that the breechblock 10 is shifted or displaced in the direction of the arrow D. The locking bolt or bolt member 36 is displaced into a position above the arm member 24 of the firing lever 21, so that the firing lever 21 is retained in the firing position depicted in FIG. 2. Additionally, the feeler or sensing lever 33 is supported from below by the stop lever 43 since such is no longer held by the release lever or lever member 50.

After the firing of a shot the breechblock 10 is again propelled back into its rear or rearmost position due to the force of the propellent charge, as is well known in this technology. In the event that the firing table 28 has not yet been lowered, in a direction opposite to the direction of the arrow B shown in FIG. 1, then the breechblock again travels towards the front for delivering a further shot or a number of shots until the firing or trigger table 28 has been again lowered.

Upon lowering of the firing table 28, opposite to the direction of the arrow B, there is only pivoted or rocked the release lever 50 in the clockwise direction, since the firing lever 21, as previously described, is still retained by the locking bolt 36. During pivoting of the release lever 50 the impact or abutment member 53 of such release lever 50 impacts against the stop lever 43 and pivots such in the clockwise direction since the release lever 50 is loaded by a stronger spring than the stop lever 43. The feeler lever 33 is therefore no longer supported from below and under the force of the spring 44 is likewise pivoted in the clockwise direction provided that this is not prevented at such time by the underside or control surface 35 of the breechblock 10 which would then press against the feeler or sensing surface 34 of the feeler lever 33. Thus, to the extent that the breechblock 10 is not located at the region of the firing mechanism, it is therefore possible, as previously described, for the feeler lever 33 to be rocked or pivoted in the clockwise direction, with the result that the likewise pivoted locking bolt 36 now releases the firing lever 21. Together with the release of the firing lever 21 there is then also released the catch pawl 11. This catch pawl 11 therefore can now move back into the path of travel of the breechblock 10. Consequently, it will be recognized that the catch pawl 11 can only move into the path of travel of the breechblock 10 when the breechblock 10 is not located in the region of the firing mechanism, i.e., when the underside 35 of the breechblock 10 has released the feeler lever 33. This underside 35 of the breechblock 10, as will be recalled, is constructed as a control or camming surface.

Hence, it will be understood that the feeler or sensing lever 33 has the important task assigned to it of releasing the firing lever 21 and also the catch pawl 11 at the proper point in time, that is to say, to release such firing lever 21 and also the catch pawl 11 when the breechblock 10 is not located at the region of the firing mechanism.

Preferably, the feeler lever 33 possesses a feeler or sensing surface 34 which is formed by two planes, wherein, the plane located at the right-hand side of the showing of FIG. 2 extends approximately parallel to the path of travel of the breechblock 10 and the other plane located at the left-hand side is inclined in an opposite direction at an acute angle with respect to such path of travel of the breechblock 10, in order to ensure for gentle contact or impingement of the breechblock 10 against the feeler lever 33.

While there are shown and described present preferred embodiments of the invention, it is to be distinctly understood that the invention is not limited thereto, but may be otherwise variously embodied and practiced within the scope of the following claims.

Accordingly, what is claimed is:

1. A firing mechanism for an automatic firing weapon, comprising:

a breechblock having a catch surface and an underside structured as a control surface for controlling the firing mechanism;

said breechblock moving along a predetermined path of travel;

a firing mechanism housing;

a spring-loaded catch pawl;

means for pivotably mounting said spring-loaded catch pawl in said firing mechanism housing;

said catch pawl being moveable between a breechblock catch position and a breechblock release position;

said catch pawl, when in its breechblock catch position, protruding into said predetermined path of travel of the breechblock;

a firing table;

a firing lever actuatable by said firing table for pivoting said catch pawl out of its breechblock catch position into said breechblock release position;

a feeler lever pivotable out of a locking position into a release position;

a stop lever cooperating with said feeler lever;

means for pivotably mounting said stop lever in said firing mechanism housing for movement out of a release position into a locking position for retaining the feeler lever in a position into which it can be pivoted and within which position it can not be pivoted by the underside of the breechblock defining said control surface and in which the feeler lever retains the catch pawl in its breechblock release position by means of said firing lever;

a release lever cooperating with said stop lever;

means for pivotably mounting said release lever in said firing mechanism housing; and said release lever together with said firing lever bearing upon said firing table and serving for delatching said stop lever.

2. The firing mechanism as defined in claim 1, wherein:

said feeler lever possesses a feeler surface defined by two planes;

one of said planes extending approximately parallel to said predetermined path of travel of the breechblock; and the other of said two planes being inclined in an opposite direction at an acute angle with respect to said predetermined path of travel of said breechblock in order to ensure for a gentle impingement of the breechblock against the feeler lever.

3. The firing mechanism as defined in claim 1, further including:

a locking bolt displacedly mounted in said feeler lever;

said locking bolt having a head portion;

said feeler lever being provided with a bore having a shoulder;

springs means for loading said locking bolt;

said firing lever having an impact member; and said locking bolt being urged by said spring means in a direction such that said head portion of said locking bolt is pressed against said shoulder of the bore of said feeler lever and in which position the locking bolt in the locking position of the feeler lever bears against said impact member of the firing lever.

4. The firing mechanism as defined in claim 1, wherein:

said firing lever retaining said catch pawl in a release position for releasing a shot from the firing weapon by means of the firing lever;

said feeler lever having a nose member for being retained in said locking position by said stop lever and a sensing surface for being retained in said locking position by said locking position by said underside of said breechblock constructed as a control surface; and said stop lever and said breechblock both being located in a release position for releasing said feeler lever.

5. The firing mechanism as defined in claim 1, further including:

a common shaft upon which there are mounted said firing lever, release lever and stop lever; and said common shaft being secured in said firing mechanism housing.

6. The firing mechanism as defined in claim 1, further including:

spring means for loading said stop lever; and said spring means loading said stop lever striving to press said stop lever into its locking position in which there is supported from below said feeler lever in its locking position.

7. The firing mechanism as defined in claim 1, wherein:

said feeler lever is positioned for being pivoted by the underside of the breechblock.

* * * * *